United States Patent [19]

Yoshino

[11] Patent Number: 4,853,015

[45] Date of Patent: Aug. 1, 1989

[54] HIGH PURITY NITROGEN AND OXYGEN GAS PRODUCTION EQUIPMENT

[75] Inventor: Akira Yoshino, Osaka, Japan

[73] Assignee: Daidousanso Co., Ltd., Osaka, Japan

[21] Appl. No.: 258,063

[22] Filed: Oct. 14, 1988

Related U.S. Application Data

[63] Continuation of Ser. No. 926,417, Oct. 14, 1986, abandoned.

[30] Foreign Application Priority Data

Feb. 2, 1985 [JP] Japan ..... 60-29042

[51] Int. Cl.[4] ..... F25J 1/02

[52] U.S. Cl. ..... 62/40; 62/24; 62/42

[58] Field of Search ..... 62/9, 11, 17, 18, 20, 62/23, 24, 27–34, 36, 42, 43, 40; 55/25, 63, 68, 74, 75

[56] References Cited

U.S. PATENT DOCUMENTS

| | | | |
|---|---|---|---|
| 3,312,074 | 4/1967 | Keith et al. | 62/18 X |
| 3,327,489 | 6/1967 | Gaumer, Jr. | 62/18 X |
| 3,363,427 | 1/1968 | Blanchard et al. | 62/30 X |
| 3,905,201 | 9/1975 | Coveney et al. | 62/28 X |
| 3,967,464 | 7/1976 | Cormier et al. | 62/18 X |
| 4,137,056 | 1/1979 | Golovko | 62/24 X |
| 4,152,130 | 5/1979 | Theobald | 62/18 |
| 4,526,595 | 7/1985 | McNeil | 62/34 X |

*Primary Examiner*—Ronald C. Capossela

*Attorney, Agent, or Firm*—Armstrong, Nikaido, Marmelstein, Kubovcik & Murray

[57] ABSTRACT

There is provided an apparatus for manufacturing nitrogen gas and oxygen gas of very high purity by cryogenic liquefaction, and without using an expansion turbine. Supercooled and compressed air is sent to a distilling tower where it is mixed with and cooled by the latent heat of vaporization of liquid nitrogen from any external source. Utilizing the difference between their boiling points, nitrogen is taken out as gas while oxygen remains as liquid. The oxygen is concentrated in an oxygen condenser and then further concentrated in an oxygen distilling tower mixed with liquid oxygen from an external source as the refrigerant.

2 Claims, 2 Drawing Sheets

HIGH PURITY NITROGEN AND OXYGEN GAS PRODUCTION EQUIPMENT

This application is a continuation of application Ser. No. 926,417 filed Oct. 14, 1986, now abandoned.

DETAILED DESCRIPTION OF THE INVENTION

1. Technical Field

Figure 1:
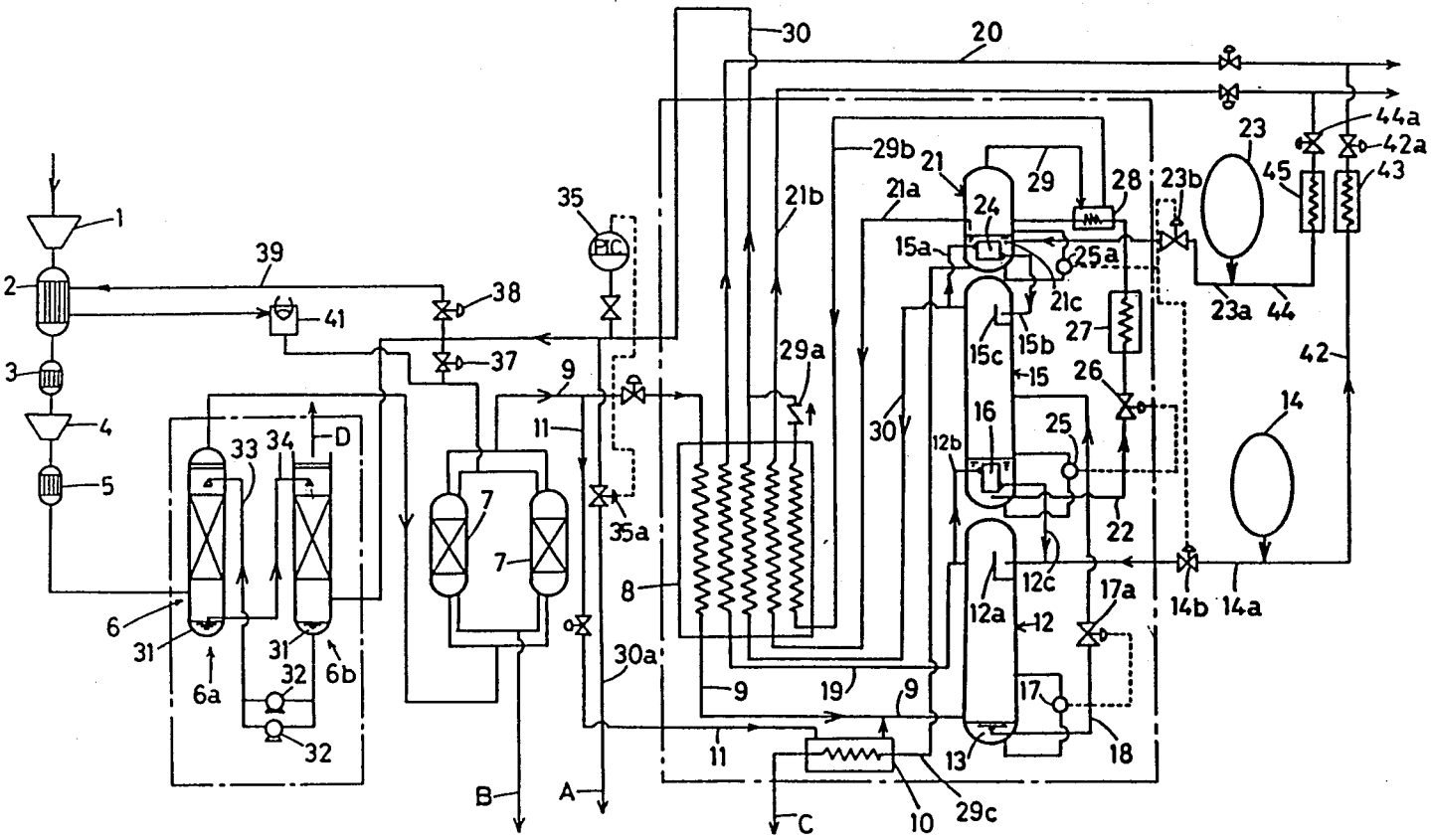

The present invention relates to an apparatus for manufacturing nitrogen and oxygen gas with high purity.

2. Prior Art

Very large quantities of nitrogen gas is used in an electronic industry and, from the viewpoint of maintaining and increasing the precision of the parts, there is a strict demand for the purity of the nitrogen gas. Thus, nitrogen gas is generally manufactured via following steps that air, the starting material, is compressed in a compressor, placed in an adsorption column to remove carbon dioxide gas and water therefrom, cooled in a heat exchanger by subjecting to a heat exchange with a refrigerant, then subjected to a cryogenic liquefaction and separation in a distilling tower, and the resulting nitrogen gas is warmed up to around the ambient temperature passing through the above heat exchanger. However, the nitrogen gas manufactured as such contains oxygen as an impurity and its direct use may cause various problems. In removing the oxygen gas contained as an impurity, (1) small amount of hydrogen gas is added to the nitrogen gas and made to react with the oxygen in an atmosphere of about 200° C. in the presence of a platinum catalyst to remove the oxygen is removed therefrom as water or (2) the oxygen gas in the nitrogen gas is made contacted in an atmosphere of about 200° C. with a nickel catalyst and the oxygen is removed therefrom as a result of a reaction of $Ni+\frac{1}{2}O_2=NiO$. However, in both of the above methods, nitrogen gas is to be contacted with the catalyst after making it at high temperature and, accordingly, the apparatus used therefor cannot be incorporated in an apparatus for manufacturing nitrogen which is operated at very low temperature. This causes a disadvantage that another purification apparatus besides the manufacturing apparatus for nitrogen is to be used and the total system will become too large. In addition, in the method (1), high precision is required in adjusting the adding amount of hydrogen and, unless the hydrogen whose amount is just correspondent to that reacting with the oxygen is supplied, oxygen still remains or added hydrogen remains as an impurity. Thus, skillful operation is requested. In another method (2), it is necessary to regenerate the NiO ($NiO+H_2=Ni+H_2O$) which is produced by the reaction with oxygen. This causes the necessity for an equipment for hydrogen gas for the regeneration and results in an increase of the purifying cost. Accordingly, an improvement in such a respect has been briskly demanded.

In conventional manufacturing apparatuses for nitrogen gas, an expansion turbine is used for cooling the refrigerant in a heat exchanger for chilling the compressed air and is operated by a gas pressure as a result of evaporation of liquid air remained in the distilling tower (low-boiling nitrogen is taken out as a gas by cryogenic liquefaction and separation and the residual part remains as a liquid air abundant in oxygen). However, the rotation speed of the expansion turbine is very high (several ten thousand revolutions per minute), so the operation corresponding to the load change s difficult and specially trained operators are necessary. Further, because of its high speed rotation, high precision is required in terms of mechanical structure and expensive too. Because of a complicated mechanism, there is a disadvantage that specially trained operators are required. Thus, the above-given problems are all because of the fact that the expansion turbine contains high-speed rotating part. Accordingly, there has been a strong demand for removing the expansion turbine having such a high-speed rotating part.

To meet with such requirements, the present inventor has already developed a manufacturing apparatus for nitrogen gas in which there is no expansion turbine and, in place of it, chilled liquid nitrogen is supplied from outside into a distilling tower and the corresponding patent application has been filed (Japanese Patent Application No. Sho-58-38050). The apparatus is able to manufacture nitrogen gas with very high purity and, accordingly, conventional purification apparatus is no longer necessary. Further, because of the absence of an expansion turbine, there is no disadvantage caused by such a turbine. Therefore, this apparatus is much suitable for an electronic industry. However, in the electronic industry, oxygen gas besides nitrogen gas is used and an apparatus which is able to manufacture not only nitrogen but also oxygen gas has been awaited.

OBJECTS OF THE INVENTION

An object of the present invention is to offer an apparatus for the manufacturing of highly pure nitrogen and oxygen gas in which neither expansion turbine nor purification apparatus is required and both highly pure nitrogen gas and highly pure oxygen gas can be manufactured at the same time.

DISCLOSURE OF THE INVENTION

In achieving the above object, the first characteristic feature of the present invention is an apparatus for manufacturing highly pure nitrogen and oxygen gas equipped with an air-compressing means in which air taken from outside is compressed, a removing means in which carbon dioxide gas and water in the compressed air by said air-compressing means are removed, a heat-exchanging means in which the compressed air after the above removing means is cooled to ultracold temperature, a liquid nitrogen-storing means in which liquid nitrogen is stored, a nitrogen distilling tower in which a part of the compressed air chilled at ultracold temperature by the above heat-exchanging means is liquefied to store it inside while only nitrogen is maintained in its gaseous state, an introducing path for liquid nitrogen in which the liquid nitrogen in the above storing means for nitrogen gas is introduced into the above nitrogen distilling tower as a cooling source for liquefying the compressed air, an outlet for nitrogen gas in which gaseous nitrogen finishing the action as a cooling source in its liquid form and another gaseous nitrogen maintained in the above nitrogen distilling tower are taken out as a nitrogen gas from the above nitrogen distilling tower, an oxygen distilling tower in which nitrogen and oxygen are separated from liquid air utilizing the difference between boiling points of them, a supplying path for liquid air in which the liquid air remaining in the above nitrogen distilling tower is supplied to the above oxygen distilling tower, a storing means for liquid oxygen in which liquid oxygen is stored, an introducing path for liquid oxygen in which the liquid oxygen in the liquid oxygen-storing means is introduced into the oxygen distilling tower as a cooling source, and an outlet for liquid oxygen gas in which both oxygen gas separated from the liquid air utilizing the difference between boiling points of oxygen and nitrogen and another oxygen gas from the liquid oxygen after finishing its work as a cooling source; and the second characteristic feature of the present invention is an apparatus for manufacturing highly pure nitrogen and oxygen gas equipped with an air-compressing means in which air taken from outside is compressed, a removing means in which carbon dioxide gas and water in the compressed air by said air-compressing means are removed, a heat-exchanging means in which the compressed air after the above removing means is cooled to ultracold temperature, a liquid nitrogen-storing means in which liquid nitrogen is stored, a nitrogen distilling tower in which a part of the compressed air chilled at ultracold temperature by the above heat-exchanging means is liquefied to store it inside while only nitrogen is maintained in its gaseous state, an introducing path for liquid nitrogen in which the liquid nitrogen in the above storing means for nitrogen gas is introduced into the above nitrogen distilling tower as a cooling source for liquefying the compressed air, an outlet for nitrogen gas in which gaseous nitrogen finishing the action as a cooling source in its liquid form and another gaseous nitrogen maintained in the above nitrogen distilling tower are taken out as a nitrogen gas from the above nitrogen distilling tower, a condensing tower for oxygen in which nitrogen in the liquid air is evaporated so that the air is made in a state of oxygen-rich, an introducing path for liquid air in which the liquid air remained in the above nitrogen distilling tower is supplied to the above oxygen condensing tower, an oxygen distilling tower in which oxygen and nitrogen are separated each other by utilizing the difference between the boiling points of them, a supplying path in which an oxygen-rich liquid air in the above oxygen condensing tower is supplied to the above oxygen distilling tower, a storing means for liquid oxygen in which the liquid oxygen is stored, an introducing path for liquid oxygen in which the liquid oxygen in the liquid oxygen storing means is introduced into the above oxygen distilling tower as a cooling source, and an oxygen gas outlet in which both oxygen gas separated from the oxygen-rich liquid air utilizing the difference between the melting points of oxygen and nitrogen and another oxygen gas from the liquid oxygen after finishing its action as a cooling source are taken out from the above oxygen distilling tower.

EFFECT OF THE INVENTION

As illustrated hereinabove, the apparatus for manufacturing highly pure nitrogen and oxygen gas in accordance with the present invention does not use an expansion turbine but, instead of it, uses storing tanks for liquid nitrogen and for liquid oxygen having no rotary part at all and, accordingly, there is no rotary part in the apparatus as a whole and it works without any trouble. Further, the storing vessel for liquid nitrogen etc are in low cost while an expansion turbine is expensive and, in addition, no specially trained operator is necessary. Since an expansion turbine is with very high revolution speed (several ten thousand revolutions per minutes; said expansion turbine is driven by a pressure of gas evaporated from liquid air in the nitrogen distilling tower), careful operation of it corresponding to changes in load (changes in the outlet amount of nitrogen gas etc) is very difficult. Therefore, it is difficult to correctly change the supplying amount of liquid air to the expansion turbine corresponding to the changes in the outlet amount of nitrogen gas etc and to cool the compressed air which is a material for the manufacture of nitrogen gas etc at certain temperature at all times. As a result, there is a inconsistency in the purity of the nitrogen gas obtained as a product frequently giving the product with lower purity and, as a whole, purity of the nitrogen gas product etc is low. In the apparatus of the present invention, a storing vessel for liquid nitrogen is used in place of it and liquid nitrogen and liquid oxygen which are possible to adjust their supplying quantities precisely are used as cooling sources. Therefore, it is now possible to operate precisely corresponding to the load change and to manufacture nitrogen and oxygen gas with constant and high purity. Accordingly, the conventional purifying apparatus is no longer necessary. In addition, the present invention apparatus uses liquid nitrogen and oxygen as cooling sources and, after they are used, they are not discarded but combined with the nitrogen and oxygen gas manufactured from air and, therefore, there is no wastefulness in materials. Furthermore, the apparatus is equipped with storing vessels for both liquid nitrogen and liquid oxygen. Accordingly, both nitrogen and oxygen gas can be manufactured either both or one of the liquid nitrogen and oxygen is used as cooling source. In other words, among the above two cooling sources, any one which is more easily available can be used as a cooling source and, therefore, the working is very convenient.

BRIEF EXPLANATION OF DRAWINGS ATTACHED

Figure 2:
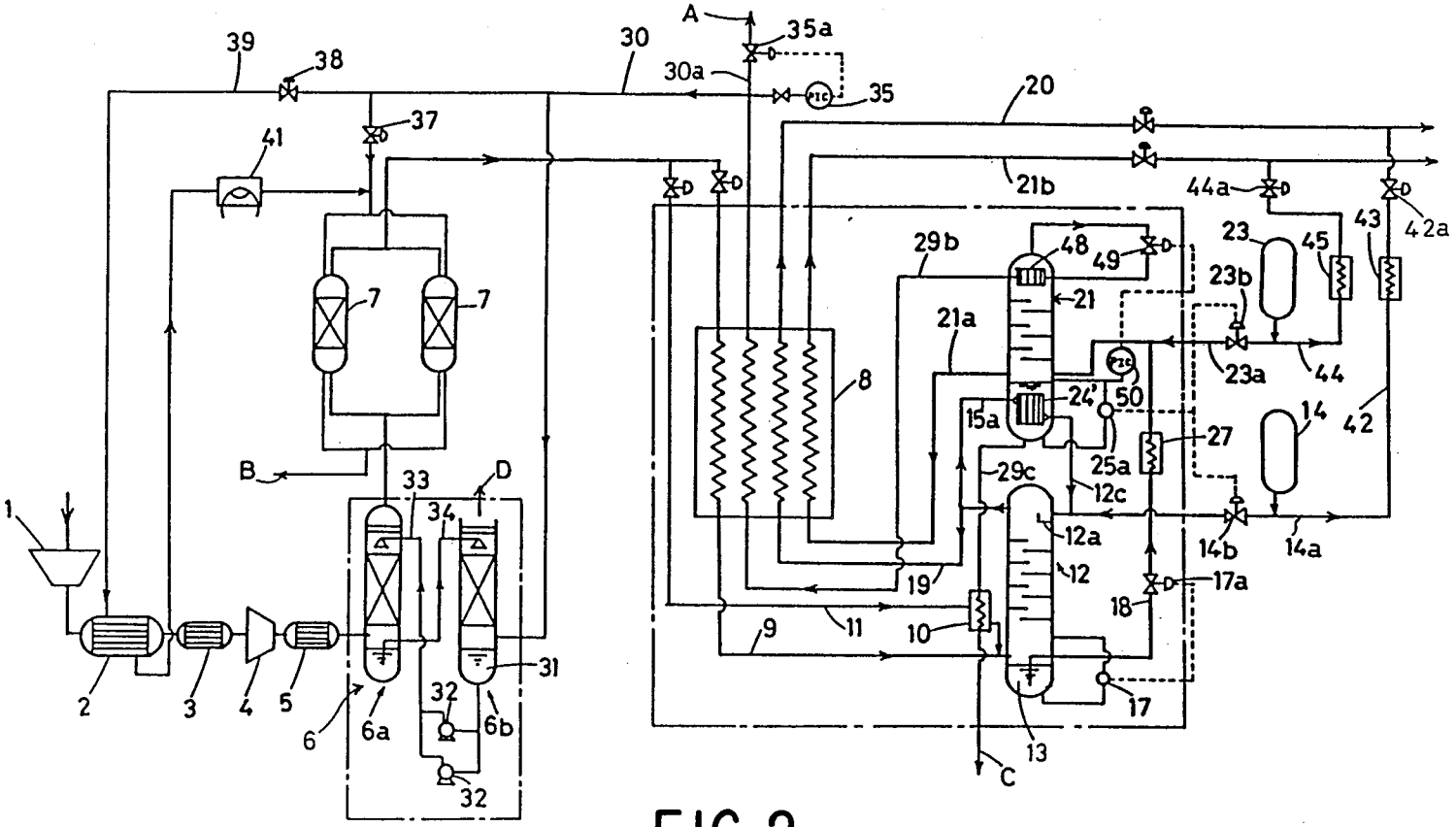

FIG. 1 is a drawing showing the construction of one example of this invention and FIG. 2 is a drawing showing the construction of another example.

BEST MODE IN WORKING THE INVENTION

The present invention is further illustrated by referring to the examples.

FIG. 1 shows one example of the present invention. In the figure, 1 is a first air compressor, 2 is a waste heat recoverer, 3 is an intercooler, 4 is a second air compressor, 5 is an aftercooler, and 6 is a set of two air cooling tubes in which one (*6a*) is a closed type and another (*6b*) is open at its top. The system contains a set of two adsorption columns 7 in which molecular sieves are placed and $H_2O$ and $CO_2$ in the air compressed by the first and second air compressors 1 and 4 are alternatively adsorbed and removed. To first heat exchanger 8, compressed air wherefrom $H_2O$ and $CO_2$ are adsorbed and removed by an adsorption column 7 is supplied from a compressed air supplying pipe 9 and cooled at supercold temperature by a heat exchanging action. Compressed air wherefrom $H_2O$ and $CO_2$ are adsorbed and removed is supplied to a second heat exchanger 10 from the above compressed air supplying pipe 9 via a branched pipe 11. The compressed air sent to the second heat exchanger 10 is also supercooled by a heat exchanging action and is combined to the supercold compressed air cooled in the above first heat exchanger 8. A nitrogen distilling tower 12 with layers cools the compressed air sent thereto via a pipe 9 after being supercooled by first and second heat exchangers 8 and 10 and a part of the compressed air is stored at the bottom as liquid air 13 while only nitrogen is taken out as gaseous state. At the upper side of this distilling tower 12, there is a trap for liquid nitrogen 12*a* a and liquid nitrogen is sent thereto from a liquid nitrogen storing vessel 14 via an introducing pipe 14*a*. The introduced liquid nitrogen overflows from the above liquid nitrogen trap 12*a*, flows down in a distilling tower 12, contacts countercurrently with the ascending compressed air from the distilling tower 12, cools it, and a part of the compressed air is liquefied. Thus, in this step, high-boiling ingredients oxygen ingredients) in the compressed air are liquefied and stored at the bottom of the distilling tower 12 while nitrogen gas in the low-boiling ingredients are stored at the upper part of the distilling tower 12. A pipe 19 for taking out the nitrogen gas stored at the upper part of the distilling tower 12 as such works as to introduce the supercold nitrogen gas into the first heat exchanger 8, to subject it to a heat exchange with the compressed air sent thereinto to make it at ambient temperature, and to send it to a main pipe 20. In this case, at the most upper part of te distilling tower 12, low-boiling He (−269° C.) and $H_2$ (−253° C.) are apt to be stored there together with nitrogen gas. Accordingly, the pipe 19 for taking out opens at considerably low positions from the top of the distilling tower 12 so that pure nitrogen gas containing no He and $H_2$ can be taken out. Oxygen condenser 15 has shelves and there is a condenser 16 in it. A part of nitrogen gas stored at the upper part of the distilling tower 12 is sent to the condenser 16 via a pipe 12*a*, liquefied, and is combined with the liquid nitrogen in the above introducing pipe 14*a* via a pipe 12*c*. The inside of the above oxygen condensation tower 15 is in more vacuum condition than that of the distilling tower 12. Liquid air 13 (containing 50–70% of $N_2$ and 30–50% of $O_2$) stored at the bottom of the distilling tower 12 is sent thereto by a pipe 18 equipped with a expansion valve 17*a* controlled by a liquid surface meter 17 whereupon the high-boiling ingredients (nitrogen ingredients) are evaporated so that the temperature inside the tower 15 is maintained at supercool while itself is stored at the bottom of the tower 15 as a supercooled liquid abundant in oxygen. As a result of a refrigerating action of this oxygen-rich supercold liquid, the nitrogen gas sent into the condenser 16 is liquefied and is combined, as already mentioned, with the liquid nitrogen in the introductory pipe 14*a*. Pipe 30 is for taking out the waste nitrogen gas wherefrom the nitrogen ingredients (the purity is not so high) stored at the upper part of the oxygen condenser 15 is taken out as a waste nitrogen gas. Thus, the above waste nitrogen gas is introduced to the first heat exchanger 8 and, by its refrigerating action, the starting air is cooled to supercold temperature. Then a part of it is introduced to the cooling pipe 6*b* whose upper part is open (this is one of the set of the two cooling columns 6), cooled by contacting with shower-like running water flowing down from the terminal nozzles of the pipe 34, and the waste gas after the heat exchanging step is exhausted into air like the arrow D while the residual part of the above waste nitrogen gas is directly exhausted into air from the branched pipe 30*a* as shown by an arrow A. In this case, a part of the waste nitrogen gas sent to the cooling pipe 6 is used for the regeneration of the adsorption column which does not work between a set of adsorption columns 7. Thus, the valve 38 is opened, supercooled waste nitrogen gas is sent, via a pipe 39, to a waste heat recoverer 2 to make it warm, then further warmed up to ambient temperature with a regenerating heater 41, sent to an adsorption column which does not work to regenerate the molecular sieve, and exhausted into air as shown an arrow B. The above molecular sieve has very little adsorbing ability at ambient temperature and, at supercold temperature, it shows an excellent adsorbability and, at the regenerated state as above, it is at ambient temperature and does not exhibit adsorbability. Therefore, after the waste nitrogen gas of the ambient temperature is flown, the valve 38 is immediately closed and another valve 37 is opened, the waste nitrogen gas of supercold temperature is made run to cool the molecular sieve, and the waste nitrogen gas after use is exhausted as shown the arrow B whereupon the regeneration of the molecular sieve is completed. A set of two adsorption columns 7 are alternatively regenerated as such as are used. Expansion valve 35*a* is controlled by a liquid level indicator 35. In the cooling column 6*b* having an open upper end, water 31 cooled by the waste nitrogen gas is stored at the bottom of the cooling column 6*b* with an open upper end, sent to the upper part of the closed type cooling column 6*a* via a pipe 33, and flown down therefrom like shower to cool the starting air sent from the air compressor 1. The water 31 after cooling is resent to the cooling column 6*b*having an open upper end by a motor 32 and is again cooled by a refrigerating action of the waste nitrogen gas. Oxygen distilling tower 21 has shelves and is connected with the bottom of the oxygen condenser 15 with a pipe 22 and takes the oxygen-rich supercooled fluid at the bottom of the oxygen condenser 15 therein utilizing the difference in pressures. In the figure 25 is a liquid level indicator, 26 is an expansion valve controlled by said liquid level indicator 25, and 27 is an acetylene absorber which absorbs acetylene in the above oxygen-rich supercooled fluid and removes it. A third heat exchanger 28 cools the above oxygen-rich supercooled fluid. The oxygen-rich supercooled fluid is further cooled by said heat exchanger 28 and, when it is taken into the oxygen distilling tower 21 as a spray by an action of the expansion valve 26, oxygen ingredients are immediately liquefied and, at the same time, nitrogen ingredients are made into gas and both ingredients are separated in high precision. To the lower part of the above oxygen distilling tower 21, liquid oxygen is sent from the liquid oxygen storing vessel 23 from an introducing pipe 23*a* as a refrigerating source, cools the condenser 24 incorporated in the oxygen distilling tower 21, liquefies the waste nitrogen gas sent from the upper part of the oxygen condensation tower 15 into the condenser 24 via a pipe 15*a*, and return it to the refluxing liquid trap 15*c* in the oxygen condensation tower 15 via the pipe 15*b*. Pipe 29 provide, the supercooled nitrogen gas stored at the upper part of the oxygen distilling tower 21 as a refrigerant for the above heat exchanger 28. Pipe 29*b* provides the nitrogen gas after working as a refrigerant to the first heat exchanger 8 and its forward terminal connects with the outlet pipe 30 for the waste nitrogen gas so that the nitrogen gas after heating exchanging is combined with the waste nitrogen gas at the first heat exchanger 8. In the figure 29*a* is a back stopper, and 25*a* is a liquid level indicator equipped in the oxygen distilling tower 21 and 23*b* is a flow rate adjusting valve which is controlled by 25*a*. The above liquid level indicator 25*a* controls not only the amount of liquid oxygen but also that of liquid nitrogen sent from the liquid nitrogen storing vessel 14 by a control to the flow rate adjusting valve 14*b* so that adequate quantities of refrigerant is sent to the distilling towers 12 and 21 at all times. Pipe 21*a* takes out oxygen gas and takes out the oxygen gas of high purity evaporated from the liquid oxygen 21*c* (99.5% purity) stored at the bottom of the oxygen distilling tower 21, introduced into the first heat exchanger 8, subjected to a heat exchange with the compressed air sent thereto to make it ambient temperature, and sent to a pipe 21*b* for taking out the product oxygen gas. Pipe 29*c* discards the liquid oxygen 21*c* stored at the bottom of the oxygen distilling tower 21 and said liquid oxygen is sent to the second heat exchanger 10, heat-exchanged with the starting air so that the starting air is cooled to supercold temperature, and is discarded as shown by an arrow C. The above liquid oxygen 21*c* stored contains impurities such as methane, acetylene and the like and, since those impurities are abundant in the lower part of the stored liquid oxygen 21*c*, the discarding pipe 29*c* opens at the bottom of the oxygen distilling tower 21. In the figure designate 42 and 44 designate lines for a back-up system and, when the air compressing line is out of order, the valves 42*a* and 44*a* are opened, the liquid nitrogen in the liquid nitrogen storing vessel 14 is evaporated by an evaporator 43 and sent to a main pipe 20 so that nitrogen gas is supplied without any intermission and, at the same time, the liquid oxygen in the liquid oxygen storing vessel 23 is evaporated by an evaporator 45 and sent to the main pipe 21*b*so that supplying of oxygen gas is not stopped too. A chain line shows a vacuum refrigerating box which inhibits the invasion of heat from outside so that the purification efficiency can be further improved.

The products—nitrogen gas and oxygen gas—can be manufactured by this apparatus as follows. Thus, air is compressed by an air compressor 1 and the heat generated thereby is recovered by a waste heat recoverer 2. The compressed air is further cooled by an intercooler 3, then compressed with an air compressor 4, then further cooled with an aftercooler 5, sent to the cooling column 6*a* of closed type, and subjected to a counter current contact with water cooled by the waste nitrogen gas to cool. Then, this is sent to an adsorption column 7 and $H_2O$ and $CO_2$ are removed by adsorption. A part of the compressed air wherefrom $H_2O$ and $CO_2$ are removed is sent to the first heat exchanger 8 via a pipe 9 to cool at a supercold temperature while residual part is sent to the second heat exchanger 10 via a branched pipe 11 to cool it at supercold temperature. Both are combined and sent to the lower part of the distilling tower 12. Then the compressed sent thereto is subjected to a counter current contact with the liquid nitrogen sent from the liquid nitrogen storing vessel 14 to the distilling tower 12 and also with the liquid nitrogen overflown from the liquid nitrogen trap 12*a* so that a part of it is liquefied and stored at the bottom of the distilling tower 12. In the above step, as a result of the difference between the boiling points of nitrogen (−196° C.) and oxygen (−183° C.), oxygen which is a high-boiling part of in the compressed air is liquefied while nitrogen remains there as it is. At the bottom of the distilling tower 12, the liquid air 13 abundant in oxygen is accumulated. Then, the nitrogen remained there in a gaseous state is taken out from a taking-out pipe 19, send to the first heat exchanger 8, warmed up near to the ambient temperature, and sent out main pipe 20 as a product—nitrogen gas of very high purity. In that case, the liquid nitrogen from the liquid nitrogen storing vessel 14 acts as a refrigerant for liquefying the compressed air while it is evaporated and taken out from the taking-out pipe 19 as a part of the product—nitrogen gas. In the meanwhile, the liquid air 13 stored at the bottom of the distilling tower 12 is sprayed into an oxygen condensation tower 15 via a pipe 18 and flown down to the bottom of the tower 15 by contacting with the overflown liquid nitrogen from the refluxing liquid trap 15*c*. At this time, the same as before, oxygen which is a high-boiling fraction is liquefied as a result of the difference between the boiling points of nitrogen and oxygen and nitrogen remains as a gaseous state and, accordingly, the oxygen concentration in the liquid air at the bottom of the tower 15 is higher than that in the liquid air 13 in the above distilling tower 12. ($O_2$: 60–80%). Then said oxygen-rich liquid air 13 is subjected to an adiabatic expansion with an expansion valve 26, then sent to an acetylene absorber 27 to remove acetylene, cooled by sending to the third heat exchanger 28, oxygen is separated therefrom by liquefaction (while nitrogen remains as a gaseous state), and sent to the oxygen distilling tower 21. Among the mixture of gas and liquid sent to the oxygen distilling tower 21, liquid oxygen accumulates at the bottom of the tower while nitrogen gas is sent, after being accumulated at the upper part of the tower 21, to the third heat exchanger 28 via a pipe 29, acts as a refrigerant, then sent to the pipe 30 for exhausting the waste nitrogen gas via the first heat exchanger 8, and discarded. Liquid oxygen is supplied to the above oxygen distilling tower 21 from the liquid oxygen storing vessel 23 as a refrigerant, accumulated at the bottom of the tower after being mixed with the liquid oxygen separated by the above liquefaction and separation, and cools the condenser 24 incorporated in the oxygen distilling tower 21. In the meanwhile, most of nitrogen gas separated in the oxygen condensation tower 15 is taken out from a pipe 30 for taking the waste nitrogen gas out, and is utilized as a refrigerant of the first heat exchanger 8 and also for regeneration of the adsorption column 7 and for manufacture of cooling water in the air cooling tube 6. Residual part of the above nitrogen gas is sent to the condenser 24 in the oxygen distilling tower 21, cooled with liquid oxygen, and liquefied one is refluxed in a refluxing liquid trap 15*c* in the oxygen condenser 15. The residue liquid oxygen 21*c* at the bottom of the above oxygen distilling tower 21 is not taken out as a product as it is but is taken out from a pipe 21*a* for oxygen gas as a gaseous state (oxygen gas) and, after being heat-exchanged at the first heat exchanger 8, it is taken out from the system as a product gas of ambient temperature. Among the liquid oxygen 21*c* in the oxygen distilling tower 21, that near the bottom contains large quantities of impurities such as acetylene and methane and, therefore, it is discarded to outside from a pipe 29*c*. As such, both nitrogen gas an oxygen gas of high purity can be simultaneously obtained by a single apparatus.

FIG. 2 shows another example of the present invention. In this apparatus, there is no oxygen condensation tower while the oxygen distilling tower 21 is made larger to make its function more effectively. It is directly connected with the nitrogen distilling tower 12 so that a part of the nitrogen gas product formed at the nitrogen distilling tower 12 is sent to the first condenser 24' in the oxygen distilling tower to cool and liquefy giving a refluxing liquid and, at the same time, liquid air remained at the bottom of the nitrogen distilling tower 12 is mixed with the liquid oxygen sent from the liquid oxygen storing vessel 23 and sent into the oxygen distilling tower 21 to separate oxygen by liquefaction. Further, the second condenser 48 is equipped in the oxygen distilling tower 21 and the waste nitrogen gas separated is used as a refrigerant for it so that the efficiency of liquefaction and separation to oxygen can be further improved. In FIG. 2, 50 is a liquid level indicator and 49 is a valve which is controlled by said liquid level indicator 50. Other parts are the same as those in FIG. 1 and, accordingly, repetition of the explanation is omitted by giving the same signs to the same parts. This apparatus exhibits the same action and effect as that of FIG. 1 does and, further, it has another advantage that the whole apparatus can be made smaller.

In both examples of FIG. 1 and FIG. 2, valves **14*b* and 23*b* of the pipes 14*a* and 23*a* can be separated from the control by the liquid level indicator 25*a* and can be controlled independently. Thus, in such apparatuses, continuous operation for producing both nitrogen gas and oxygen gas is possible by the use of the refrigerant from one of the liquid nitrogen storing vessel 14 and liquid oxygen storing vessel 23. If one of the refrigerant is no available by any reason, the above valves 14*b* and 23*b*** are handled immediately so that the operation can be continued using another refrigerant.

We claim:

1. An apparatus for manufacturing highly pure nitrogen and oxygen gas consisting essentially of an air-compressing means for compressing outside air, a removing means for removing carbon dioxide gas and water in the air compressed by said air compressing means, a heat-exchanging means for cooling the compressed air from the above removing means to supercold temperature, a liquid nitrogen-storing means for storing liquid nitrogen supplied from outside of the apparatus, a nitrogen-distilling tower in which apart of the compressed air chilled at supercold temperature by the above heat-exchanging means is liquefied to store it inside while only nitrogen is maintained in its gaseous state, liquid nitrogen introducing means for introducing liquid nitrogen from the above storing means for nitrogen gas into the above nitrogen distilling tower as the refrigerant for liquefying the compressed air, an outlet for nitrogen gas provided in the nitrogen-distilling tower in which gaseous nitrogen from the liquid nitrogen refrigerant and gaseous nitrogen produced in the above nitrogen distilling tower are taken out as a nitrogen gas from the above nitrogen distilling tower, an oxygen distilling tower in which nitrogen and oxygen are separated from liquid air utilizing the difference between their boiling points, a liquid air supplying means for supplying liquid air remaining in the nitrogen distilling tower to the oxygen distilling tower, a storing means for storing liquid oxygen supplied from outside of the apparatus, liquid oxygen introducing means for introducing liquid oxygen from the liquid oxygen-storing means into the oxygen distilling tower as the refrigerant, and liquid oxygen gas outlet means for removing both oxygen gas separated from the liquid air utilizing the difference between boiling points of oxygen and nitrogen and oxygen gas from the liquid oxygen refrigerant from the oxygen distilling tower.

2. The apparatus of claim 1 further comprising an oxygen condensing tower for receiving liquid air from the nitrogen distilling tower and separating nitrogen from said liquid air to produce a liquid air having a higher concentration of oxygen and for supplying the liquid air product to the oxygen distilling tower via the liquid air supplying means.

* * * * *

UNITED STATES PATENT AND TRADEMARK OFFICE

CERTIFICATE OF CORRECTION

PATENT NO. : 4,853,015

DATED : August 1, 1989

INVENTOR(S) : Akira YOSHINO

It is certified that error appears in the above-identified patent and that said Letters Patent is hereby corrected as shown below:

Column 2, line 2, "change s" should read --change is--.

Column 3, line 61, "vessel for" should read --vessels for--.

Column 5, line 3, "12a a and" should read --12a and--;
line 11, "ingredients oxygen" should read --ingredients (oxygen--;
line 21, "part of te" should read --part of the--.

Column 6, line 25, "6bhaving" should read --6b having--;
line 29, "pipe 22 and" should read --pipe 22, and--.

Column 7, line 27, "pipe 21bso" should read --pipe 21b so--;
line 64, "out main" should read --out from a main--.

Column 9, line 21, "is no" should read --is not--.

Signed and Sealed this

Third Day of April, 1990

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,853,015

DATED : August 1, 1989

INVENTOR(S) : Akira YOSHINO

It is certified that error appears in the above-identified patent and that said Letters Patent is hereby corrected as shown below:

On the cover page, Item [30], "Feb. 2, 1985" should read --Feb. 16, 1985--.

Signed and Sealed this

Nineteenth Day of June, 1990

*Attest:*

HARRY F. MANBECK, JR.

*Attesting Officer*

*Commissioner of Patents and Trademarks*